US007645219B1

(12) United States Patent
Buth

(10) Patent No.: US 7,645,219 B1
(45) Date of Patent: Jan. 12, 2010

(54) RECUMBENT THERAPEUTIC SYSTEM

(76) Inventor: Fredrick A. Buth, 517 N. Franklin St., Shawano, WI (US) 54166

( * ) Notice: Subject to any disclaimer, the term of this patent is extended or adjusted under 35 U.S.C. 154(b) by 145 days.

(21) Appl. No.: 12/008,542

(22) Filed: Jan. 12, 2008

(51) Int. Cl.
*A63B 26/00* (2006.01)

(52) U.S. Cl. ..... 482/142; 482/121; 601/1; 601/5

(58) Field of Classification Search ..... 482/142, 482/148, 23; 601/1, 5; 446/220
See application file for complete search history.

(56) References Cited

U.S. PATENT DOCUMENTS

| | | | | |
|---|---|---|---|---|
| 2,253,996 | A | | 8/1941 | Bechman |
| 2,714,007 | A | | 7/1955 | Jordan |
| 2,941,801 | A | | 6/1960 | Pedersen |
| 2,950,120 | A | | 8/1960 | Stewart |
| 3,188,087 | A | | 6/1965 | Larson, Jr. |
| 3,361,427 | A | | 1/1968 | Paves |
| 3,416,792 | A | | 12/1968 | Morgan et al. |
| 3,967,820 | A | | 7/1976 | Harper |
| 4,193,592 | A | | 3/1980 | Bishow |
| 4,218,093 | A | | 8/1980 | Gertz |
| 4,613,131 | A | | 9/1986 | Anderson |
| 4,787,630 | A | | 11/1988 | Watson et al. |
| 5,238,296 | A | | 8/1993 | Paul |
| 5,254,060 | A | * | 10/1993 | Bohanan ..... 482/60 |
| 5,496,248 | A | | 3/1996 | Batscher |
| D375,985 | S | | 11/1996 | Dailey et al. |
| 5,582,567 | A | | 12/1996 | Chang |
| 5,643,164 | A | | 7/1997 | Teff |
| 5,713,820 | A | | 2/1998 | Carbone |
| 5,772,612 | A | | 6/1998 | Ilan |
| 5,795,276 | A | | 8/1998 | Almeda |
| 5,807,210 | A | | 9/1998 | Devlin |
| 5,891,002 | A | | 4/1999 | Maki |
| 5,897,474 | A | | 4/1999 | Romero |
| 5,980,433 | A | | 11/1999 | Ramsay |
| 6,272,703 | B1 | | 8/2001 | Swezey et al. |
| 6,375,601 | B1 | | 4/2002 | Johnson |
| 6,421,935 | B1 | | 7/2002 | Bartlett |
| 6,428,451 | B1 | | 8/2002 | Hall |

(Continued)

OTHER PUBLICATIONS

Gaiam; Healthy Circulation Machine www.Gaiamliving.com; Jan. 10, 2007 (or Earlier).

(Continued)

*Primary Examiner*—Lori Baker
(74) *Attorney, Agent, or Firm*—bobharter.com; Robert J. Harter

(57) ABSTRACT

A portable recumbent therapeutic system that can be used for relaxing, exercising and stimulating a user's legs, sacrum, back, arms and other parts of the body, and to do so all at the same time while minimizing the negative effect of a person's own body weight. The therapeutic system utilizes three complementary and interdependent support members while the user is in a horizontal reclined position. Because the three members are complementary and interdependent on each other the user often feels a sensation of weightlessness similar to exercising in water. The user's arms, for example, are able to swing freely as desired which simultaneously changes or affects the movement and utilization of the other two members and vice versa. When listening to music the system can provide the user with perhaps a feeling of dancing on air. The therapeutic system moves in response to the user and requires no power source.

15 Claims, 4 Drawing Sheets

U.S. PATENT DOCUMENTS

| | | | | |
|---|---|---|---|---|
| 6,554,748 | B2 | 4/2003 | Tollner | |
| 6,705,977 | B1 | 3/2004 | Ziak | |
| 6,752,772 | B2 * | 6/2004 | Kahn | 601/98 |
| 6,767,313 | B2 | 7/2004 | Sayce | |
| 6,835,168 | B2 | 12/2004 | Huang | |
| 6,837,835 | B2 | 1/2005 | Huang | |
| 6,837,836 | B2 | 1/2005 | Huang | |
| 6,929,588 | B2 * | 8/2005 | Hobson | 482/138 |
| 6,942,604 | B2 | 9/2005 | Teff | |
| 6,945,920 | B1 | 9/2005 | Kemery et al. | |
| 7,011,612 | B2 | 3/2006 | Repking | |
| 7,118,517 | B1 | 10/2006 | Hale | |
| 7,137,926 | B2 | 11/2006 | Barrows | |
| 7,137,938 | B2 | 11/2006 | Gottlieb | |
| 7,175,577 | B2 | 2/2007 | Greenspan et al. | |

OTHER PUBLICATIONS

Sunpentown; Swing Machine With Swivel Disc www. Factorydirect2you.com; Jan. 10, 2007 (or Earlier).

* cited by examiner

RECUMBENT THERAPEUTIC SYSTEM

FIELD OF THE INVENTION

The subject invention generally pertains to a therapeutic and relaxation system and more specifically to a system that emulates dancing in a generally horizontal position.

BACKGROUND OF RELATED ART

Various therapeutic devices have been developed for rehabilitating individuals with physical injuries or other problems. Such devices are often designed for treating a certain type of injury and thus focus on a particular area of a patient's body. U.S. Pat. No. 4,848,742, for instance, discloses a rocking device for stretching or relaxing a person's back muscles. A person engages the device with their feet, hips and hands and then rocks, oscillates or rotates his body to stretch or relax the back muscles. Since the feet, hips and hands all engage elements that are restrained or attached at a generally fixed location relative to each other, there is limited relative movement of those body parts as the person uses the device.

Other exercise devices, such as the one disclosed in U.S. Pat. No. 5,496,248 to Batscher, permit much greater freedom of movement. The Batscher device, however, appears to be meant for individuals that are sufficiently coordinated and are in relatively good physical condition. Many of the elderly or other people who have difficulty supporting their own weight while exercising might have trouble using the Batscher device.

To reduce the load of a person's body weight, many patients prefer exercising in water. Although this can be effective, swimming pools are often quite expensive, they are not always readily available, and they are typically not portable.

Other therapeutic or relaxation devices require an electrical power source, and such electrical power might not always be readily available. Moreover, electrically powered devices might force users into certain movements without the users having to exert any useful energy of their own.

Consequently there is need for a portable therapeutic system that can exercise or stimulate a person's whole body by producing and enhancing a gentle rebound reaction that can have a wave like reaction throughout the user's body.

SUMMARY OF THE INVENTION

It is an object of the present invention to provide a therapeutic system (i.e., therapeutic device and/or therapeutic method) that can be used for relaxing, exercising and/or stimulating a user's legs, sacrum, back, arms and other parts of the body, and do so all at the same time.

Another object is to provide a user-powered therapeutic system that can be used for exercising and stimulating a user's legs, sacrum, back, arms and other parts of the body without the need for an electric power source.

Another object is to provide a therapeutic system that can be used for exercising and stimulating a user's legs, sacrum, back, arms and other parts of the body, while minimizing the negative effect of a person's body weight.

Another object is to provide a therapeutic system that can be used for relaxing, exercising and stimulating a user's legs, sacrum, back, arms and other parts of the body and perhaps improving a person's lymphatic system by producing a gentle rebound reaction through utilization of a cradle/springboard member.

Another object of some embodiments, is to add music and emulate dancing; however, the "dancing" is done in a generally horizontal position to reduce the load and impact of the user's body weight.

Another object of some embodiments is to provide a therapeutic system that permits relative movement of a person's limbs while helping create a sensation of swimming or weightlessness without the need for water.

Another object of some embodiments is to provide a therapeutic system that might help a person relax.

Another object of some embodiments is to provide a therapeutic system that might increase a person's flexibility.

Another object of some embodiments is to provide a therapeutic system that might improve a person's blood circulation, metabolism, and/or immune system.

Another object of some embodiments is to provide a therapeutic system that might help a person feel good mentally, emotionally and/or physically.

Another object of some embodiments is to provide a therapeutic device that can be readily adjusted to fit users of various hip-to-calf dimension, various hip-to-head dimension, and various combinations thereof.

Another object of some embodiments is to provide a therapeutic device that operates under the impetus of user movement, thus avoiding the need for electrical source.

Another object of some embodiments is to provide a sacrum/lowback-supporting member that can swivel to accommodate a user's calves rocking from side to side.

Another object of some embodiments is to provide a sacrum/lowback-supporting member having a relative coefficient of friction that enables the sacrum/lowback-supporting member to rotate back and forth while providing sufficient friction to inhibit the user from sliding off the support.

Another object of some embodiments is to provide a sacrum/lowback-supporting member with a contoured and supportive body engaging surface that is softer than its downward facing contact surface so that the sacrum/lowback-supporting member is both comfortable and rotatable.

Another object of some embodiments is to provide a therapeutic system that is collapsible and portable.

Another object of some embodiments is to provide a therapeutic device with support members comprised of a plurality of foam pads of varying-compressibility to create a progressive response to weight applied to the support members.

Another object of some embodiments is to provide a therapeutic device with support members that avoid localized pressure points by providing the support members with cavities and/or a plurality of foam pads of varying compressibility. The support members provide comfort and support for bony structures like the spine and sacral areas.

One or more of these and/or other objects of the invention are provided by a recumbent therapeutic device and/or method that can be used for exercising, relaxing and/or stimulating a user's legs, sacrum, back, arms and other parts of the body, and do so all at the same time while minimizing the negative effect of a person's body weight.

In some embodiments, the invention involves the use of a bed, massage table or floor; a board of strong material adapted to be set upon the bed, massage table or floor; a cradle/springboard including a contoured soft and supportive ankle, calve or thigh engaging surface made of wood and various densities of cushions. This cradle is attached to a springboard consisting of flexible plywood, which is secured to a mat at both ends in the front and bottom area of the tapered flexible material, which is cushioned by a ¼ in rubber riser, which is secured to the mat. The back bottom of springboard is contoured and cushioned with an adjustable wood riser in the center attached by hook and loop to the underside of the mat. When the user activates either the ankles, calves or thighs horizontally, vertically or sideways along cradle the weight and shift creates a gentle rebound reaction coming from the springboard and affecting other areas of the user's body in a gentle and stimulating ripple/wave like affect. Once activated, the three members have a rebound affect on each other thus making the exercise almost effortless and creating a sensation of floating on water or dancing effortlessly in air. A disc which is a sacrum/low back supportive member with a contoured and supportive body engaging surface and an adjustable downward engaging surface that attaches and is secured in various positions by hook and loop contact to the mat. The back supporting member for supporting the upper back and torso of the user is contoured and cushioned to aid in comfort, support and flexibility of the user. This member adjusts user's height and remains stable during use as does the cradle. During use of the device the user utilizing the disc member moves horizontally between the fixed cradle/springboard and back supporting members. All three members raise their body area and have a pivot process in common creating and allowing an extended range of motion of flexibility and maneuverability in all aspects of user's body based on their coordination and awareness.

DESCRIPTION OF THE PREFERRED EMBODIMENT

Figure 1:
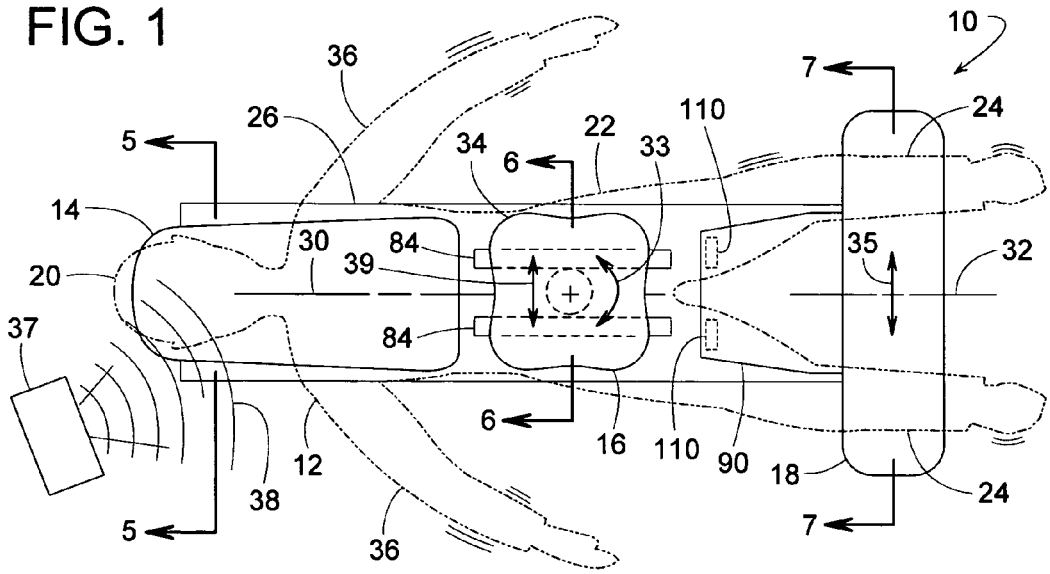
FIG. 1 is a top view of a recumbent therapeutic system.
Figure 2:
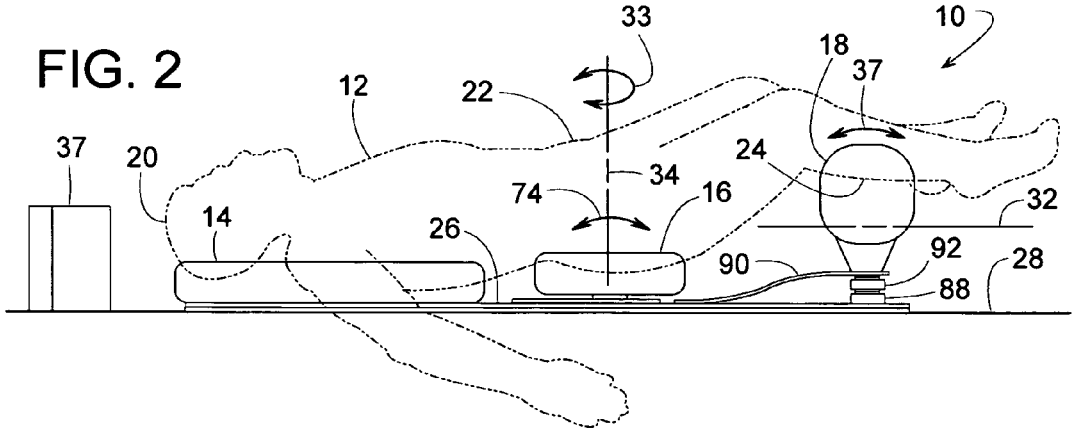
FIG. 2 is a side view of FIG. 1.
Figure 3:
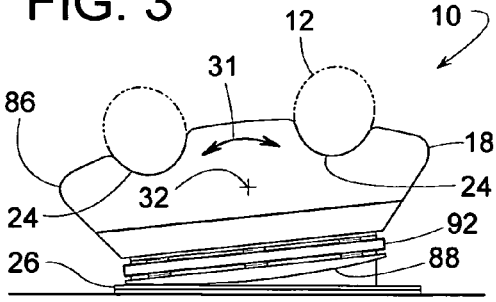
FIG. 3 is a right end view of FIG. 1 but showing the calve-supporting member tilted toward one side.
Figure 4:
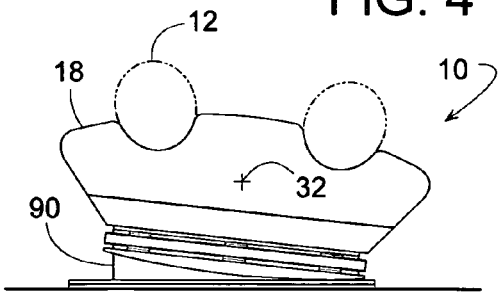
FIG. 4 is a right end view similar to FIG. 3 but showing the calve-supporting member having rocked toward an opposite side.

FIGS. 1-4 and FIGS. 8-9 show a therapeutic device 10 for relaxing and revitalizing a user 12. Additional details of device 10 can be seen in FIGS. 5-7. Device 10 includes a back/head-supporting member 14, a sacrum/lowback-supporting member 16, and a cradle 18 that together help support user 12 in a generally reclined, horizontal position. Back/head-supporting member 14 helps support a head 20 and upper back; sacrum/lowback-supporting member 16 supports a sacrum 22 and lower back; and cradle 18 helps support calves 24, thighs and ankles of user 12. Cradle 18, sacrum/lowback-supporting member 16, and/or back/head-supporting member 14 can be supported by a mat 26, which in turn can be set upon a surface 28 (e.g., a floor, bed, massage table, etc.). Mat 26 could be flexible or rigid. When properly set up, back/head-supporting member 14, sacrum/lowback-supporting member 16 and cradle 18 lie along an imaginary longitudinal axis 30 that runs generally lengthwise and horizontally along mat 26.

When user 12 is lying face up on device 10 with the user's head 20 resting comfortably upon back/head-supporting member 14 (with or without an additional pillow or neck support member), cradle 18 enables user 12 to easily rock 31 calves 24 and thighs from side to side (arrows 31 and 35) and front to back (arrow 37), as shown in FIGS. 1-4. As calves 24 and thighs rock about an imaginary rocking axis 32 that is preferably above and substantially parallel to axis 30, sacrum/lowback-supporting member 16 is free to swivel 33 or rotate back and forth about an imaginary vertical axis 34 that is substantially perpendicular to axes 30 and 32. In addition to being able to rotate, sacrum/lowback-supporting member 16 can also rock from side to side (arrow 39) and front to back (arrow 74). The rotating and rocking action of sacrum/lowback-supporting member 16 helps avoid straining user 12 as the user's calves 24 and thighs rock.

While members 14, 16 and 18 support much of the user's body weight, the user's arms 36 can swing as desired or simply rest upon surface 28. In some cases, therapeutic device 10 can provide user 12 with an unusual sensation of weightlessness or a feeling of floating on water. To further enhance the pleasant sensation and encourage user 12 to move head 20, sacrum 22, arms 36, and calves 24 simultaneously, rhythmically, and harmoniously; music 38 from a speaker 39 can be played nearby, thereby providing user 12 with perhaps an additional feeling of dancing weightlessly in air.

Figure 5:
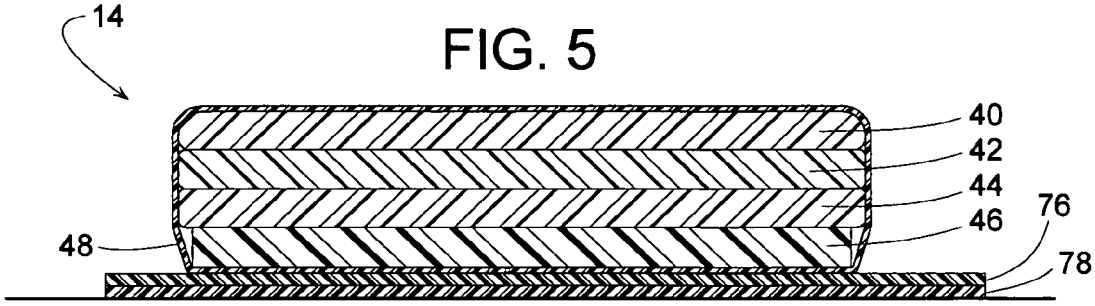
FIG. 5 is a cross-sectional view taken along line 5-5 of FIG. 1.
Figure 11:
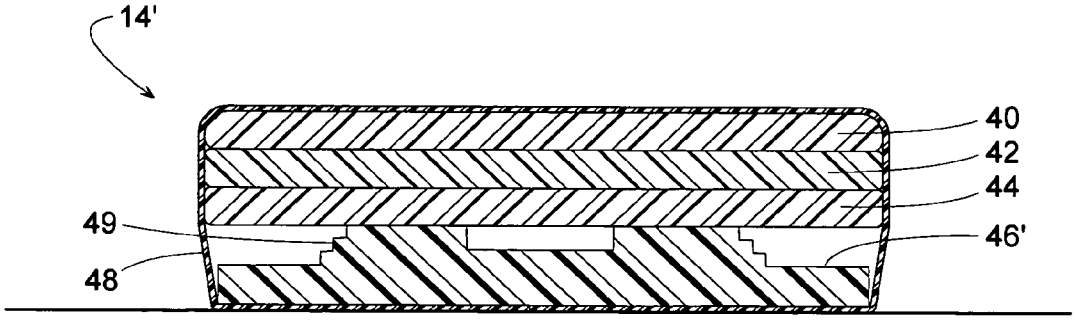
FIG. 11 is a cross-sectional view similar to FIG. 5 but illustrating an alternate embodiment.

Although the structural details of therapeutic device 10 may vary, in a currently preferred embodiment, back/head-supporting member 14 comprises a plurality of resiliently compressible foam pads 40, 42 and 44, as shown in FIG. 5. The density or compressibility of pads 40, 42 and 44 can be similar or identical, or their material properties can vary. Pad 40, for example, can be softer than pads 42 and 44 (or vice-versa), and one or more of pads 40, 42 and 44 could be comprised of a memory-type foam material. To provide back/head-supporting member 14 with body and support, a generally rigid foam panel 46 can be added. Panel 46 and pads 40, 42 and 44 are preferably contained within a readily removable fabric cover 48. An alternate version of back/head-supporting member 14 is illustrated in FIG. 11.

Figure 6:
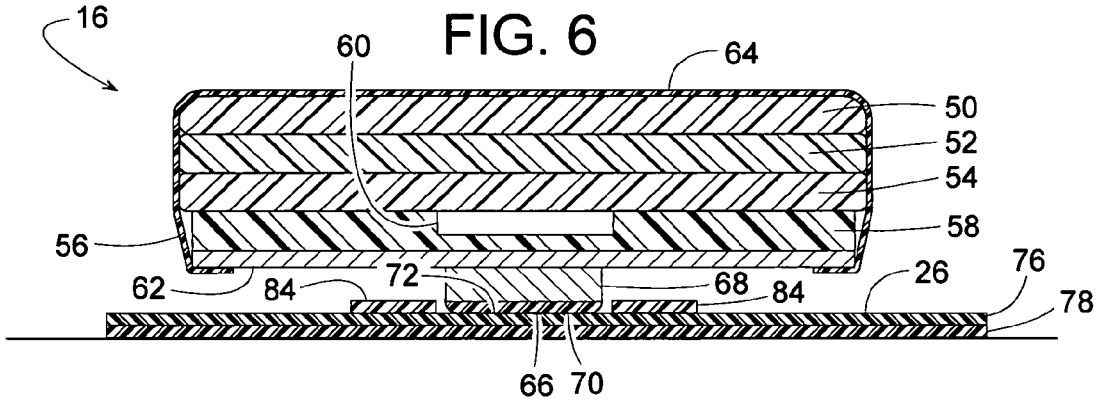
FIG. 6 is a cross-sectional view taken along line 6-6 of FIG. 1.

Referring to FIG. 6, sacrum/lowback-supporting member 16 can also be comprised of a plurality of resiliently compressible foam pads 50, 52 and 54 contained within a fabric cover 56. The density or compressibility of pads 50, 52 and 54 can be similar or identical, or their material properties can vary. Pad 50, for example, can be softer than pads 52 and 54 (or vice-versa), and one or more of pads 50, 52 and 54 could be comprised of a memory-type foam material. Sacrum/lowback-supporting member 16 might also include a generally rigid foam panel 58 that defines a recess or cavity 60 that helps member 16 from exerting localized pressure against, for example, the user's tailbone.

A panel 62 made of wood or similarly stiff and strong material helps transfer the user's body weight from a contoured and supportive body engaging surface 64 of member 16 to a downward facing contact surface 66 of member 16. By virtue of a wood button 68 and an optional hard plastic cap 70 (i.e., button 68 could be made solely of wood with or without Velcro underneath it), downward facing contact surface 66 protrudes from the underside of panel 62 and engages an upward facing contact surface 72 of mat 26. A first coefficient of friction between surfaces 66 and 72 is relatively low to allow sacrum/lowback-supporting member 16 to freely swivel or rotate about axis 34. The protruding button 68 also provides sacrum/lowback-supporting member 16 with a fulcrum upon which sacrum/lowback-supporting member 16 can rock (arrows 39 and 74), thereby providing user 12 with additional freedom of movement. To limit the degree to which member 16 can tilt or rock, member 4 has a width or outer periphery that is wider than the diameter of button 68. A second coefficient of friction of contoured and supportive body engaging surface 64 with respect to a fabric-like material, such the user's clothing or the upward facing contact surface 72, is preferably greater than the first coefficient of friction to help ensure that user 12 does not accidentally slip off of sacrum/lowback-supporting member 16. In other versions of the design, however, Velcro is attached to the underside of button 68 to help hold the button in position. Such an alternate design will be explained later with reference to FIG. 12.

Figure 8:
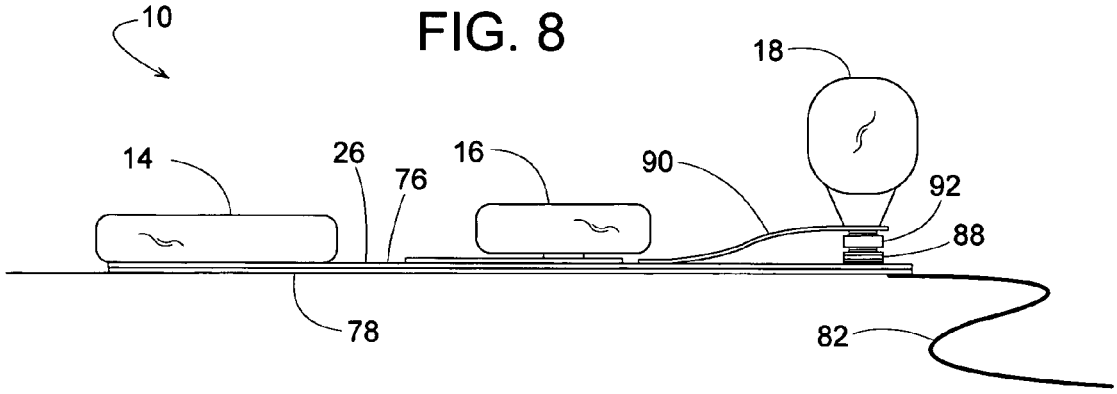
FIG. 8 is a side view similar to FIG. 2 showing the mat in an operative position.
Figure 9:
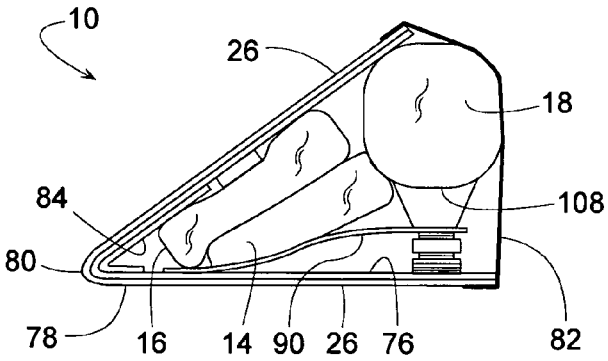
FIG. 9 is a side view similar to FIG. 8 but showing the mat in a stored position.

In some cases, mat 26 comprises an upper layer 76 made of a carpet-like material and a lower layer 78 made of a stiffer but still flexible material (e.g., ⅛-inch wood paneling or ⅜-inch plywood 2-ft.×4-ft.). Referring to FIGS. 8 and 9, layers 76 and/or 78 can be provided with a bendable edge 80 (e.g., mechanical hinge, taped joint, integral living hinge, etc.) so that mat 26 can be selectively configured between an operative position (FIG. 8) and a stored position (FIG. 9). A carrying strap 82 or equivalent cord connected to mat 26 can be used to help hold mat 26 in the stored position and make it easier to hand carry and transport device 10.

Referring back to FIGS. 1 and 6, slightly elevated guide tracks 84 (optional) running generally parallel to longitudinal line 30 can be added to mat 26 to help keep button 68 of sacrum/lowback-supporting member 16 properly aligned to line 30 while permitting sacrum/lowback-supporting member 16 to be adjustable in a direction substantially parallel to longitudinal line 30. Such adjustments helps fit device 10 to users of different size. It should be noted that guide tracks 84 are optional and that other means for restraining button 68 to mat 26 are possible, as will be described with reference to FIG. 12.

Figure 7:
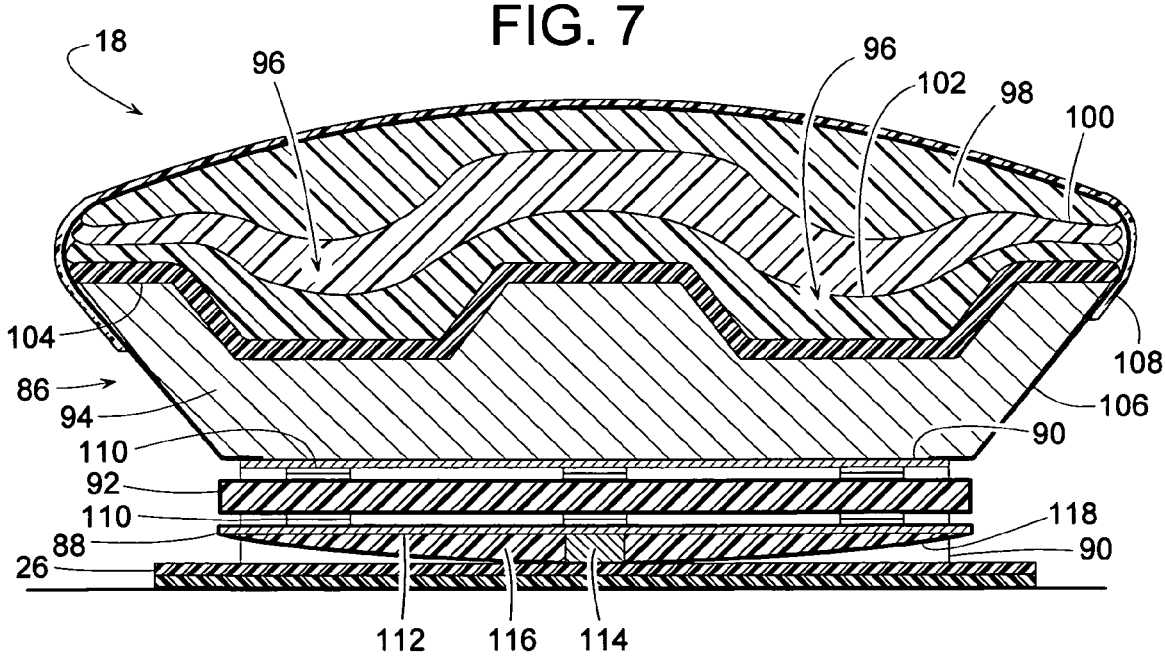
FIG. 7 is a cross-sectional view taken along line 7-7 of FIG. 1.

Referring to the embodiment of FIG. 7, cradle 18 comprises a cushion assembly 86, a rocking assembly 88, a springboard 90, and an optional spacer 92 (i.e., space 92 is not absolutely necessary and thus could be eliminated). In this particular example, cushion assembly 86 comprises a wood base 94 with upper recesses 96 for receiving calves 24. A plurality of resiliently compressible foam pads 98, 100, 102 and 104 are stacked atop base 94, and this assembly is then contained within a fabric cover 106. For additional protection and ease of cleaning, a readily removable fabric cover 108 can also be added.

The density or compressibility of pads 98, 100, 102 and 104 can be similar or identical, or their material properties can vary. Pad 98, for example, can be softer than pads 100, 102 or 104 (or vice-versa), and one or more of the pads could be comprised of a memory-type foam material. Foam pad 104 is preferably relatively dense to help protect calves 24 from feeling any sharp edges of base 94.

Springboard 90, which is made of a resiliently flexible material, couples cradle 18 to mat 26. Springboard 90 helps hold cradle 18 at a proper position on mat 26, yet the flexibility of springboard 90 provides cradle 18 with the freedom to rock relative to mat 26. The rocking direction can be side to side as indicated by arrows 31 and 35 (FIGS. 1 and 3), and/or the rocking action can be from front to back as indicated by arrow 37 of FIG. 2. Springboard 90 can be attached to mat 26 and cradle 18 using any suitable means including, but not limited to, staples, hook-and-loop fastener, rivets, tacks, wire, etc. If a hook-and-loop fastener 110 is used (see FIG. 1), such a fastener between springboard 90 and mat 26 allows the position of cradle 18 to be readily adjusted relative to mat 26. In an alternate embodiment, a single rubber piece and hook-and-loop fastener are centrally mounted to the underside of the springboard. Such an alternate design will be explained later with reference to FIG. 10.

For the example shown in FIG. 7, rocking assembly 88 comprises an upper wood panel 112 from which a wood peg 114 extends downward to provide cradle 18 with a fulcrum upon which to rock. A foam pad 116 adjacent to panel 112 and peg 114 can be used to help dampen the rocking movement. A protective cover 118 preferably encases panel 112, peg 114 and pad 116.

A hook-and-loop fastener 110 can be used for attaching rocking assembly 88 directly to the underside of cushion assembly 86, or spacer 92 can be interposed between assemblies 86 and 88 to adjust or vary the elevation of cushion assembly 86. Again, it should be noted that spacer 92 is optional and could be eliminated. To adjust the elevation, spacer 92 could be made of various heights, or multiple spacers 92 can be installed in a stacked arrangement.

Figure 10:
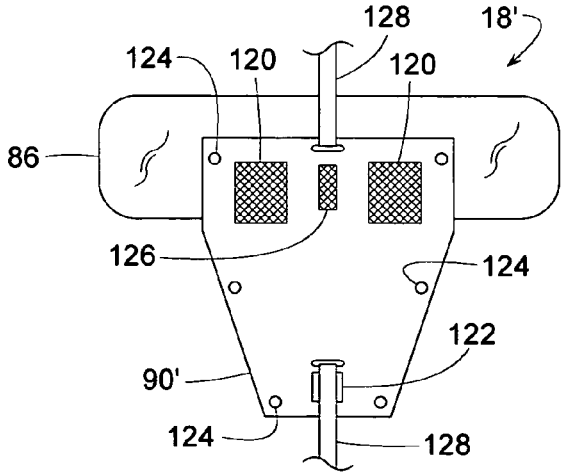
FIG. 10 is a bottom view of a cradle.
Figure 12:
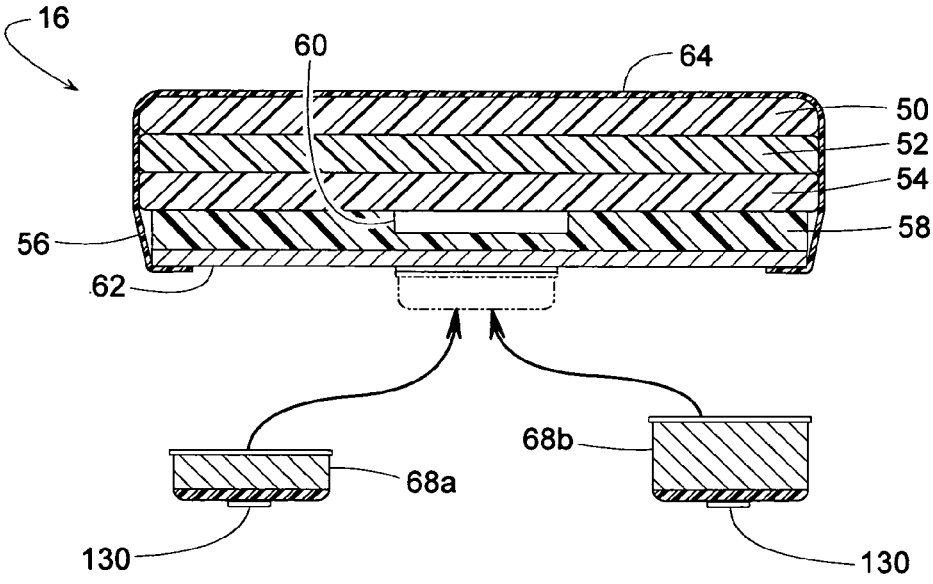
FIG. 12 is a cross-sectional view similar to FIG. 6 but showing an alternate embodiment with interchangeable buttons.

Variations well within the scope of the invention are shown in FIGS. 10-12. FIG. 10 shows an underside view of an alternate cradle 18', wherein cushion assembly 86 is mounted to a springboard 90' that is similar to springboard 90. Springboard 90', however, includes shock absorbing carpet-like pads 120, a rubber-like pad or protrusion 122 that promotes the spring/rocking action of cradle 18', and a series of rubber-like bumpers 124 that softly limit the rocking motion of cradle 18'. A hook-and-loop fastener 126 facilitates the addition or removal of various risers underneath springboard 90'. One or more straps 128 can be used to help tether springboard 90' to mat 26.

As an alternative to back/head-supporting member 14, FIG. 11 shows a back/head-supporting member 14' that includes a generally rigid foam panel 46'. To avoid applying concentrated pressure against a user's backbone, panel 46' includes a recess or cavity 47 for relieving such pressure. Panel 46' includes a series of steps 49 for comfort and to promote the rocking motion of the user.

FIG. 12 shows how buttons **68*a* or 68*b* can be used instead of button 68 to help hold sacrum/lowback-supporting member 16 to mat 26. In this case, buttons 68*a* and 68*b* include a hook-and-loop fastener 130 that can grip the carpet-like surface of mat 26, thus guide tracks 84 can be omitted. Buttons 68*a* and 68*b* are of different height so that user 12 can selectively vary the degree to which sacrum/lowback-supporting supporting member 16 can rock. Another hook-and-loop fastener 132 can be used to add and remove buttons 68*a* and 68*b* to the underside of sacrum/lowback-supporting member 16**.

Although the invention is described with respect to a preferred embodiment, modifications thereto will be apparent to those of ordinary skill in the art. The scope of the invention, therefore, is to be determined by reference to the following claims:

The invention claimed is:

1. A therapeutic device that helps support at least one of a head, upper back, sacrum, thighs and calves of a user, wherein the user is generally reclined above at least one of a floor and a bed, the therapeutic device comprising:

a flexible mat adapted to be set upon at least one of the floor and the bed;

a cradle for supporting the calves of the user, the cradle comprising a calf-engaging surface and a curved lower surface, the curved lower surface being supported by the flexible mat, the curved lower surface being harder than the calf engaging surface;

a resiliently flexible springboard connecting the cradle to the flexible mat;

a sacrum/lowback-supporting member for supporting the sacrum of the user, the sacrum/lowback-supporting member comprising a contoured and supportive body engaging surface and a downward facing contact surface, the downward facing contact surface resting upon the mat, the downward facing contact surface being harder than the contoured and supportive body engaging surface, the sacrum/lowback-supporting member being spaced apart from the cradle; and a back/head-supporting member for supporting the upper back of the user, the back/head-supporting member being spaced apart from both the cradle and the sacrum/lowback-supporting member, wherein:

a) the cradle, the sacrum/lowback-supporting member, and the back/head-supporting member being distributed along a longitudinal line;

b) the sacrum/lowback-supporting member being interposed between the cradle and the back/head-supporting member;

c) the cradle being manually rockable about a rocking axis that is substantially parallel to the longitudinal axis;

d) the sacrum/lowback-supporting member being manually rockable back and forth about a rotating axis that is substantially vertical and perpendicular to the longitudinal axis; and e) the cradle and the sacrum/lowback-supporting member being manually movable relative to each other.

2. The therapeutic device of claim 1, wherein the cradle and the sacrum/lowback-supporting member move simultaneously in reaction to movement of the user.

3. The therapeutic device of claim 1, further comprising a hook-and-loop fastener that connects the cradle to the mat in such a way that a position of the cradle relative to the mat is adjustable in a direction parallel to the longitudinal line.

4. The therapeutic device of claim 1, wherein the mat includes an upward facing contact surface upon which the sacrum/lowback-supporting member rests upon, wherein a first coefficient of friction between the downward facing contact surface and the upward facing contact surface is less than a second coefficient of friction between the contoured and supportive body engaging surface and the upward facing surface of the mat, whereby the first coefficient of friction facilitates relative rotation between the sacrum/lowback-supporting member and the mat.

5. The therapeutic device of claim 1, further comprising a guide track disposed on the mat and running generally parallel to the longitudinal line, the sacrum/lowback-supporting member engages the guide track to render the sacrum/lowback-supporting member adjustable in a direction substantially parallel to the longitudinal line.

6. The therapeutic device of claim 1, wherein the mat is selectively configurable to a stored position and an operative position, the mat being more compact in the stored position than in the operative position.

7. The therapeutic device of claim 1, further comprising a carrying strap connected to the mat such that the carrying strap facilitates carrying the therapeutic device when the mat is in the stored position.

8. The therapeutic device of claim 1, wherein the back/head-supporting member includes a plurality of foam pads having different degrees of compressibility.

9. The therapeutic device of claim 1, wherein the sacrum/lowback-supporting member includes a plurality of foam pads having different degrees of compressibility.

10. The therapeutic device of claim 1, wherein the cradle includes a plurality of foam pads having different degrees of compressibility.

11. A therapeutic device that helps support at least one of a head, upper back, sacrum, thighs and calves of a user, wherein the user is generally reclined, the therapeutic device comprising:

a flexible mat adapted to be set upon a supporting surface;

a cradle for supporting the calves of the user, the cradle comprising a calf-engaging surface and a curved lower surface, the curved lower surface being supported by the flexible mat, the curved lower surface being harder than the calf engaging surface;

a resiliently flexible springboard connecting the cradle to the flexible mat;

a sacrum/lowback-supporting member for supporting the sacrum of the user, the sacrum/lowback-supporting member comprising a contoured and supportive body engaging surface and a downward facing contact surface, the downward facing contact surface resting upon the mat, the downward facing contact surface being harder than the contoured and supportive body engaging surface, the sacrum/lowback-supporting member being spaced apart from the cradle; and a back/head-supporting member for supporting the upper back of the user, the back/head-supporting member being spaced apart from both the cradle and the sacrum/lowback-supporting member, wherein:

a) the cradle, the sacrum/lowback-supporting member, and the back/head-supporting member being distributed along a longitudinal line;

b) the sacrum/lowback-supporting member being interposed between the cradle and the back/head-supporting member;

c) the cradle being manually rockable about a rocking axis that is substantially parallel to the longitudinal axis;

d) the sacrum/lowback-supporting member being manually rockable back and forth about a rotating axis that is substantially vertical and perpendicular to the longitudinal axis;

e) the cradle and the sacrum/lowback-supporting member being movable simultaneously in reaction to movement of the user;

f) the cradle and the sacrum/lowback-supporting member being manually movable relative to each other;

g) the mat being selectively configurable to a stored position and an operative position; and h) the mat being more compact in the stored position than in the operative position.

12. The therapeutic device of claim 11, further comprising a hook-and-loop fastener that connects the cradle to the mat in such a way that a position of the cradle relative to the mat is adjustable in a direction parallel to the longitudinal line.

13. The therapeutic device of claim 11, wherein the mat includes an upward facing contact surface upon which the sacrum/lowback-supporting member rests upon, wherein a first coefficient of friction between the downward facing contact surface and the upward facing contact surface is less than a second coefficient of friction between the contoured and supportive body engaging surface and the upward facing surface of the mat, whereby the first coefficient of friction facilitates relative rotation between the sacrum/lowback-supporting member and the mat.

14. The therapeutic device of claim 11, further comprising a guide track disposed on the mat and running generally parallel to the longitudinal line, the sacrum/lowback-supporting member engages the guide track to render the sacrum/lowback-supporting member adjustable in a direction substantially parallel to the longitudinal line.

15. The therapeutic device of claim 11, wherein the cradle includes a plurality of foam pads having different degrees of compressibility.

* * * * *